US010251452B2

(12) United States Patent
Baker

(10) Patent No.: US 10,251,452 B2
(45) **Date of Patent: *Apr. 9, 2019**

(54) RIGID CANTILEVERED STUD

(71) Applicant: NIKE, Inc., Beaverton, OR (US)

(72) Inventor: Brian D. Baker, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 303 days.

This patent is subject to a terminal disclaimer.

(21) Appl. No.: 15/148,212

(22) Filed: May 6, 2016

(65) Prior Publication Data

US 2016/0249709 A1 Sep. 1, 2016

Related U.S. Application Data

(63) Continuation of application No. 13/887,791, filed on May 6, 2013, now Pat. No. 9,351,537, which is a (Continued)

(51) Int. Cl.
*A43C 15/14* (2006.01)
*A43C 15/16* (2006.01)

(Continued)

(52) U.S. Cl.
CPC ..... *A43C 15/14* (2013.01); *A43B 13/223* (2013.01); *A43B 13/26* (2013.01); *A43C 15/02* (2013.01); *A43C 15/161* (2013.01); *A43C 15/162* (2013.01)

(58) Field of Classification Search
CPC ..... A43C 15/14; A43C 15/02; A43C 15/161; A43C 15/162; A43B 13/223; A43B 13/26
See application file for complete search history.

(56) References Cited

U.S. PATENT DOCUMENTS 2,095,095 A * 10/1937 Howard ..... 36/59 R
3,063,171 A 11/1962 Hollander (Continued)

FOREIGN PATENT DOCUMENTS

CN 2244329 Y 1/1997
CN 2623055 Y 7/2004

(Continued)

OTHER PUBLICATIONS

First Office Action in CN201510004863.0 dated Mar. 2, 2016, with English translation.

(Continued)

*Primary Examiner* — Jila M Mohandesi
(74) *Attorney, Agent, or Firm* — Banner & Witcoff, Ltd.

(57) ABSTRACT

Articles of footwear may include selectively engageable traction elements that engage with a surface or the ground during certain activities and do not engage with the surface or the ground during other activities. The selectively engageable traction elements are caused to engage with the ground or surface when a portion of the footwear is flexed. When the footwear is in its unflexed position, the selectively engageable traction elements may not engage with the ground or surface. Selectively engageable traction elements may be desired or may be useful during particular, targeted movements such as sharp turns, pivoting, sudden or abrupt starting and stopping motions, and the like and in changing environmental conditions, such as on various surfaces having different characteristics. Wearers of such footwear may benefit from the extra traction provided by the selectively engageable traction elements when performing the targeted movements and/or when wearing the footwear on surfaces with varying conditions.

21 Claims, 6 Drawing Sheets

Related U.S. Application Data continuation of application No. 12/572,154, filed on Oct. 1, 2009, now Pat. No. 8,453,354.

(51) Int. Cl.

| | |
|---|---|
| ***A43B 13/22*** | (2006.01) |
| ***A43C 15/02*** | (2006.01) |
| ***A43B 13/26*** | (2006.01) |

(56) References Cited

U.S. PATENT DOCUMENTS

| | | | | |
|---|---|---|---|---|
| 4,550,510 | A | 11/1985 | Stubblefield | |
| 4,590,693 | A | 5/1986 | Kawashima et al. | |
| 4,633,600 | A | 1/1987 | Dassler et al. | |
| 4,715,133 | A | 12/1987 | Hartjes et al. | |
| 5,956,871 | A | 9/1999 | Korsen | |
| 6,722,061 | B2 | 4/2004 | Auger et al. | |
| 2005/0072026 | A1* | 4/2005 | Sink | 36/127 |
| 2005/0217149 | A1 | 10/2005 | Ho | |
| 2006/0016101 | A1 | 1/2006 | Ungari | |
| 2006/0021254 | A1 | 2/2006 | Jones | |
| 2010/0186261 | A1* | 7/2010 | Baker et al. | 36/134 |
| 2014/0338229 | A1 | 11/2014 | Jones | |

FOREIGN PATENT DOCUMENTS

| | | | |
|---|---|---|---|
| CN | 2901938 | Y | 5/2007 |
| CN | 101214097 | A | 7/2008 |
| EP | 1839511 | A2 | 10/2007 |
| FR | 2818876 | A1 | 7/2002 |
| WO | 0008962 | A1 | 2/2000 |

OTHER PUBLICATIONS

Office Action in CN201510004863.0 dated Dec. 6, 2016.

Jun. 28, 2018—(EP) Communication with European Search Report —App 18164606.

* cited by examiner

RIGID CANTILEVERED STUD

CROSS-REFERENCE TO RELATED APPLICATION

This application is a continuation of U.S. patent application Ser. No. 13/887,791, filed May 6, 2013, and titled "Rigid Cantilevered Stud", which application is a continuation of U.S. patent application Ser. No. 12/572,154, filed Oct. 1, 2009, and titled "Rigid Cantilevered Stud" (now U.S. Pat. No. 8,453,354). Application Ser. Nos. 13/887,791 and 12/572,154, in their entirety, are incorporated by reference herein.

FIELD OF THE INVENTION

Aspects of the invention relate generally to traction elements for articles of manufacture and articles of wear, such as articles of footwear. More specifically, aspects of the invention relate to selectively engageable traction elements for articles of footwear.

BACKGROUND

Many articles of wear benefit from traction elements. Such articles of wear come into contact with a surface or another item and benefit from the increased friction and stability provided by traction elements. Traction elements typically form a portion of the ground-contact surface of the article of wear. Many traction elements form protrusions that extend away from the surface of the article of wear toward the ground or surface that contacts the article of wear. Some traction elements are shaped to pierce the ground or surface when the article of wear comes into contact with the ground or surface. Other traction elements are shaped or have characteristics that engage with the ground in a way that increases the friction between the article of wear and the surface that it contacts. Such traction elements increase lateral stability between the traction element and the ground or surface and reduce the risk that the article of wear will slide or slip when it contacts the ground or surface.

Many people wear footwear, apparel, and athletic and protective gear and expect these articles of wear to provide traction and stability during use. For example, articles of footwear may include traction elements that are attached to a sole structure that forms the ground-contact surface of the article of footwear. The traction elements provide gripping characteristics that help create supportive and secure contact between the wearer's foot and the ground. These traction elements typically increase the surface area of the ground-contact surface of the footwear and often form protrusions that are usually shaped to pierce the ground and/or create friction between the ground-contact surface of the footwear and the ground or surface that it contacts.

Conventionally, these traction elements are static with respect to the article of footwear. This means that the traction elements and the footwear move as a single unit, i.e., the traction elements remain stationary with respect to other portions of the footwear and/or its sole structure. The traction elements progress through the bending and flexing motions of the step or run cycle in the same way as the rest of the footwear.

Athletes engaged in certain sports, such as soccer, baseball, and football, often utilize footwear having traction elements. These athletes perform various movements that have sudden starts, stops, twisting, and turning. Additionally, most athletes wish to wear their articles of footwear in various environments with surfaces having different conditions and characteristics. Static traction elements provide the same type of traction during all movements and in all environments, regardless of the type of movement being performed by the athlete or the characteristics of the environment in which the articles of footwear are being worn.

Additionally, some movements that wearers perform are not able to engage the static traction elements and some surfaces have characteristics that make engaging the static traction elements difficult. The wearer will progress through a step cycle or run cycle that flexes various portions of the article of footwear. Throughout the step or run cycle various portions of the footwear are engaged with the ground or surface while other portions of the footwear are suspended from the ground or surface. Most traction elements are static and move as a single unit with the article of footwear as the wearer goes through the step or run cycle. Oftentimes, various movements in which only a portion of the article of footwear is engaged with the ground or surface may not be provided with the additional traction that the static traction elements provide. Further, various surfaces on which the athlete wishes to wear their articles of footwear have different characteristics including different hardnesses and contours, which can be difficult for at least some static traction elements to engage.

Therefore, while some traction elements are currently available, there is room for improvement in this art. For example, an article of footwear wear having traction elements that may be selectively engageable to provide a user with additional traction during specific motions and on varying surfaces, while remaining comfortable and flexible for the user would be a desirable advancement in the art. Additionally, traction elements that protect against wear and that dynamically engage with a surface in response to a specific application of force, often relating to a targeted motion or a changing characteristic of the surface, would also be a welcomed advancement in the art.

SUMMARY

The following presents a general summary of aspects of the invention in order to provide a basic understanding of at least some of its aspects. This summary is not an extensive overview of the invention. It is not intended to identify key or critical elements of the invention and/or to delineate the scope of the invention. The following summary merely presents some concepts of the invention in a general form as a prelude to the more detailed description provided below.

Aspects of this invention relate to selectively engageable traction elements for articles of wear, such as footwear. In an example footwear embodiment, the article of footwear may incorporate a sole structure having a selectively engageable traction element (the term "selectively engageable," as used herein, means that the traction element is not engaged with the ground at all times when the sole structure is engaged with the ground). The sole structure may have a sole base member that forms a portion of the ground-contact surface of the sole structure and a rigid cantilevered stud having an attached end and an opposing free end. The attached end of the rigid cantilevered stud is attached to the sole base member (or is fixed with respect to the sole base member at its attached end). The free end extends away from the attached end and forms a portion of the ground-contact surface of the sole structure during at least some times of a step cycle. When the sole structure is in an unflexed position, the free end of the rigid cantilevered stud is a first distance away from the surface of the sole base member (this "first distance" may be 0 mm such that at least some portion of the free end contacts the sole base member in the unflexed position). When the sole structure is in a flexed position, the free end of the rigid cantilevered stud is a second distance away from the surface of the sole base member, wherein the second distance is greater than the first distance. Such a configuration allows the free end to selectively engage with the surface that the sole structure contacts. This type of sole structure may be incorporated into any article of footwear, including, but not limited to soccer cleats.

In another footwear example, an article of footwear may comprise an upper and a sole member engaged with the upper. The sole member may have a forefoot region, a midfoot region, and a heel region. A first traction element may have an attached end and an opposing free end. The attached end of the first traction element may be attached to the sole member. The free end extends away from the attached end. The free end of the first traction element is positioned a first distance away from a surface of the sole member when the sole member is in an unflexed position (which may means in contact with the sole member surface, as noted above) and is positioned a second distance away from the surface of the sole member when the sole member is in a flexed position. The second distance is greater than the first distance. In essence, the free end is farther away from the surface of the sole member when the sole member is in the flexed position as compared to the unflexed position. The first traction element may have a length between the attached end and the free end that is sufficient to permit the free end to form part of the ground-contact surface of the article of footwear when the sole member is in the flexed position. An article of footwear may include one or more traction elements having attached ends and free ends of the types described above.

In still another footwear example, an article of footwear may comprise an upper and a sole member attached to the upper. The sole member may include one or more rigid cantilevered studs of the types described above, and this sole member may form a portion of the ground-contact surface of the article of footwear.

BRIEF DESCRIPTION OF THE DRAWINGS

A more complete understanding of the present invention and certain advantages thereof may be acquired by referring to the following description along with the accompanying drawings, in which like reference numbers indicate like features, and wherein.

Figure 1:
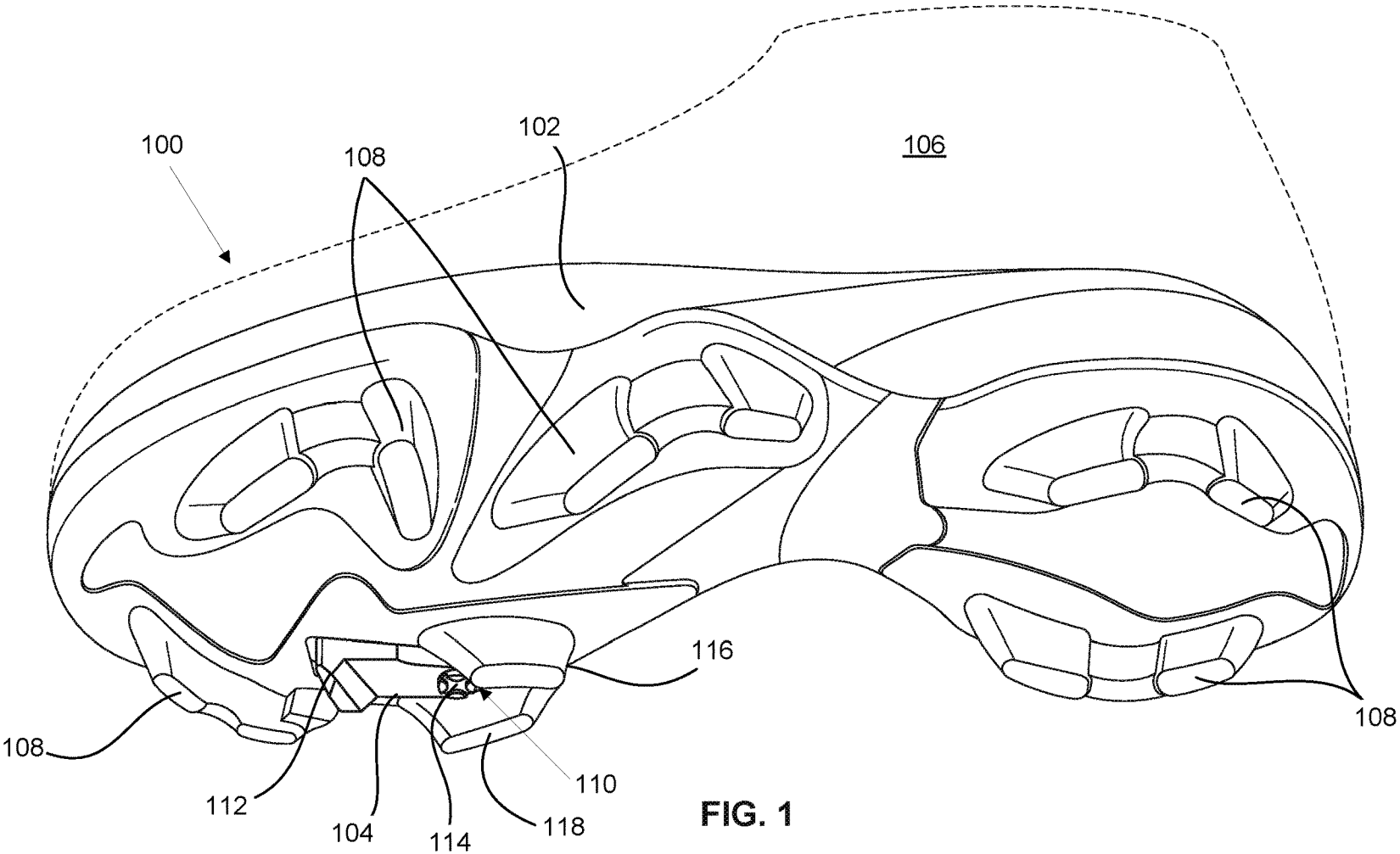
FIG. 1 illustrates an exemplary selectively engageable traction element incorporated into an article of footwear in accordance with aspects of the invention.

The reader is advised that the attached drawings are not necessarily drawn to scale.

DETAILED DESCRIPTION

In the following description of various example embodiments of the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention.

A. General description of articles of footwear with selectively engageable traction elements The following description and accompanying figures disclose various sole structures for articles of footwear. These sole structures may have selectively engageable traction elements. The selectively engageable traction elements may be discrete elements from the sole structure or may be integrally formed with the sole structure. In some examples, the selectively engageable traction elements may be detachable from the sole structure altogether.

The sole structures may be incorporated into any type of article of footwear. In more specific examples, the sole structures are incorporated into athletic footwear for sports including, but not limited to soccer, football, baseball, track, golf, mountain climbing, hiking, and any other sport or activity in which an athlete would benefit from a sole structure having selectively engageable traction elements of the types described above (and described in more detail below).

Generally, articles of footwear comprise an upper attached to a sole structure. The sole structure may extend along the length of the article of footwear and may comprise an outsole that may form the ground contacting surface of the article of footwear. Traction elements may be attached to and form portions of the outsole and/or ground contacting surface. In some examples, the sole structure includes a sole base member and one or more traction elements.

Articles of footwear may generally be divided into three regions for explanatory purposes although the demarcation of each region is not intended to define a precise divide between the various regions of the footwear. The regions of the footwear may be a forefoot region, a midfoot region, and a heel region. The forefoot region generally relates to the portion of the foot of a wearer comprising the metatarsophalangeal joints and the phalanges. The midfoot region generally relates to the portion of the foot of a wearer comprising the metatarsals and the "arch" of the foot. The heel region generally relates to the portion of the wearer's foot comprising the heel or calcaneous bone.

One or more traction elements may be positioned in any region or a combination of regions of the sole structure of the article of footwear. For example, one or more traction elements may be positioned in the forefoot region of the article of footwear. Further, traction elements may be positioned on any side of the article of footwear including the medial side and the lateral side. In more specific examples, a traction element may be positioned along the medial or lateral edge of the sole structure of the footwear. The traction elements may also be placed in any suitable position on the sole structure. For example, a traction element may be positioned on the sole structure beneath the first metatarsophalangeal joint of a wearer's foot if the wearer's foot was positioned within the footwear. The traction elements may be strategically positioned to provide additional traction when the wearers most need it, i.e., during specific targeted activities and/or when a particular kind of force is applied to the sole structure by the ground and/or the wearer's foot. The traction elements may be positioned in any suitable configuration on the sole structure and in any region of the sole structure.

Wearers may greatly benefit from additional, selectively engageable traction elements in their footwear during certain movements. Wearers participating in athletic activities, for example, may need to perform sudden or abrupt starting and stopping motions, rapid accelerations, sharp turning or twisting motions, and quick changes in direction of their movement. Wearers may benefit from additional traction during these movements. However, when the wearer is performing movements within a normal walk or run cycle such as walking, jogging, and running, the wearer may not wish to have the additional traction engage. In some instances, the additional traction may be distracting or otherwise burdensome during normal walk and run cycle movements. Selectively engageable traction elements may benefit those users that wish to experience additional traction only during specific movements or under particular circumstances (e.g., changing environmental conditions). Alternatively, if desired, selectively engageable traction elements of the types described herein may engage the ground on every step in which a significant bending of the forefoot over the metatarsophalangeal joint is accomplished.

Generally, traction elements cause friction between the sole structure and the ground or surface that it contacts to provide support and stability to the users of the articles of footwear during various movements. Traction elements increase the surface area of the sole structure and are often shaped to pierce the ground when contact with the ground occurs. Such piercing decreases lateral and longitudinal slip or slide of the footwear as it contacts the ground and increases stability for the wearer. The similar philosophy applies to selectively engageable traction elements. When the selectively engageable traction element is engaged, the traction element pierces the ground thereby improving stability and decreasing the risk of lateral and/or longitudinal slip and slide between the footwear and the ground.

The selectively engageable traction elements may be any suitable shape and size. The surfaces of the selectively engageable traction elements may be smooth or textured and curved or relatively flat. For example, the selectively engageable traction elements may be tapered from the free end to the attached end of its body. The selectively engageable traction elements may have a smooth surface or may have edges or "sides," such as a polygon. The sides or edges may be angled or smooth.

Additionally, either or both of the selectively engageable and the static traction elements may be conical, rectangular, pyramid-shaped, polygonal, or other suitable shapes. In one example, an article of footwear may have a plurality of selectively engageable and/or the static traction elements and the traction elements may all be a uniform shape. In another example, the plurality of selectively engageable and/or static traction elements may be various shapes. The traction elements may be solid or may have a hollow interior. The selectively engageable and/or static traction elements may be of any size. In the example configuration where a plurality of selectively engageable and/or static traction elements are attached to the sole structure, each of the traction elements may be the same size or they may be of varying sizes (with either uniform or non-uniform shapes). Some example selectively engageable and/or static traction elements may be tapered as they extend away from the surface of the sole structure. The tip of the selectively engageable and/or static traction elements may be a point, a flat surface, or any other suitable configuration. The tip may be beveled, curved, or any other suitable shape.

The sole structure may contain one or more selectively engageable traction elements. In some examples, the sole structure has a single selectively engageable traction element. This traction element may be positioned within the forefoot region of the sole structure or any other region of the footwear. It may also be positioned beneath the portion of the sole structure that is beneath the first metatarsophalangeal joint of the wearer's foot when the wearer's foot is inserted within the footwear. As other alternatives, a selectively engageable traction element may be positioned closer to the tip of the big toe, on the outside of the forefoot region, in the heel region (e.g., for use when backpedaling or stopping), etc.

The surface of the selectively engageable and/or static traction elements may have any texture or pattern. In some examples, the surface of the selectively engageable and/or static traction elements is smooth. In other examples, the surface may be textured to cause friction with the surface (e.g., the ground) with which the traction element comes into contact. For example, a selectively engageable and/or static traction element may have a surface with various ribs or portions that are cut out. In other examples, a pin, spike, or other protrusion may extend from or be attached to the surface of the selectively engageable and/or static traction elements to cause additional friction when the traction elements are in contact with a surface. Any friction-creating elements may be attached to the selectively engageable and/or static traction elements in any suitable manner.

Selectively engageable and/or static traction elements may be attached to the sole structure or any other portion of the articles of footwear. For example, selectively engageable and/or static traction elements may be attached to and form a portion of the sole structure of articles of footwear. The selectively engageable and/or static traction elements may also be attached to and form a portion of the midsole of the article of footwear. Selectively engageable and/or static traction elements may be detachable from the article of footwear. Some example articles of footwear have selectively engageable and/or static traction elements that are replaceable via a mechanical connector, such as a thread and a screw combination. The selectively engageable and/or static traction elements and the sole structure or a portion thereof may be integrally formed. The selectively engageable and/or static Traction elements may be attached to articles of footwear in any suitable manner and may be formed with any portion of the articles of footwear. The selectively engageable and/or static traction elements may be positioned in any suitable configuration within the sole structure and may be configured to engage with the ground in any desired manner.

Articles of footwear may include various types of selectively engageable traction elements. Some selectively engageable traction elements may be activated when a wearer of the footwear performs a particular action or applies a particular or substantial force to the sole structure of the footwear or when the contour of the ground or surface changes. For example, some selectively engageable traction elements may have a cantilever construction in which one end of the traction element is attached to the sole structure of the footwear in some manner and the opposing free end of the traction element and/or the sole structure is able to rotate or pivot around the point of attachment to the sole structure. In this manner, the selectively engageable traction element acts as a cantilever so that when a force is applied to bend the sole structure, the free end of the cantilever and/or the sole structure is caused to rotate about its point of attachment to the sole structure.

For the selectively engageable traction elements that are in the form of a cantilever construction, the cantilever may have an attached end that is secured to the sole structure, a free end opposite from and extending away from the attached end, and a main body portion interconnecting the attached end and the free end. The free end of the selectively engageable traction element (or cantilever) may be positioned a first distance away from the surface of the sole structure when the sole structure is in an unflexed position (and it may be at least partially in contact with the surface of the sole structure) and the free end of the cantilever is positioned a second distance away from the surface of the sole structure when the sole structure is in a flexed position. In this example, the second distance is greater than the first distance. Also in this example, the main body portion of the selectively engageable traction element has a first length between the attached end and the free end that is sufficient to permit the free end to form part of the ground-contact surface of the footwear when the sole structure is in the flexed position. The main body portion may extend along the surface of the sole structure without being permanently fixed to the surface. The sole structure may comprise a sole base member and the cantilevered selectively engageable traction element.

The "flexed" position of the sole structure occurs when at least a portion of the sole structure bends, rotates, or otherwise flexes around an axis defined by some point on the surface of the sole structure. In one example, the point is defined at the point of attachment (attached end) of the selectively engageable traction element to the sole structure. In another example, the point is positioned somewhere within the forefoot region of the sole structure (which may or may not also be the point of attachment of the selectively engageable traction element). The point may be positioned in any region of the sole structure and may be in any location from the lateral to the medial edge of the sole structure. The "unflexed" position of the sole structure occurs when very little or none of the sole structure is bent, rotated, or otherwise flexed around a point from its un-stressed or resting orientation. In essence, the "unflexed" position occurs when the sole structure is in its natural state without forces being applied to it.

The attached end of the selectively engageable traction element may be attached to the sole structure (or sole base member) in any suitable manner. For example, a bolt arrangement may be used to secure the attached end to the sole structure. The attached end may define a hole through which the bolt may be fitted and secured to the sole structure. Any other mechanical attachment may be used to secure the attached end to the sole structure or any portion thereof. Other forms of attachment may include molding, bonding, sewing, gluing, and the like. If desired, the attachment may be releasable so that the selectively engageable traction element may be removed from the sole structure and replaced with a new one, etc.

In some example configurations of footwear, a selectively engageable traction element is positioned in the forefoot region of the article of footwear. When the sole structure is flexed in its forefoot region, such as during a normal step or run cycle, the free end of the cantilever extends away from the surface of the sole structure and engages the ground (the sole structure and the free end rotate away from one another). When the forefoot region of the sole structure is in an unflexed position, the free end of the cantilever is closer to the surface of the sole structure than when the sole structure is in a flexed position. In one example configuration, the cantilevered selectively engageable traction element may be positioned so that at least a portion of the traction element extends beneath the first metatarsophalangeal joint of a wearer's foot when the wearer's foot is inserted into the footwear. This configuration would cause the selectively engageable traction element to extend away from the surface of the sole structure when the wearer flexes his or her first metatarsophalangeal joint, such as during a normal walk or run cycle, during a pivoting, planting, or turning motion, or the like (e.g., when the wearer puts weight on his/her toes). In some more specific examples, the attached end of the selectively engageable traction element (or cantilever) is attached to the sole structure at a position that is approximately beneath the wearer's first metatarsophalangeal joint or somewhat toward the heel from the first metatarsophalangeal joint. If desired, the main body portion of the selectively engageable traction element may lie across the joint about which the sole structure is flexed.

The selectively engageable traction element in the form of a cantilever may include a rigid material that is relatively inflexible to bending during an application of force to the sole structure and/or when in contact with the ground. The rigid material may be any suitable material. In one example, the rigid material is a metal or an alloy of metals (e.g., steel, aluminum, titanium, alloys containing one or more of these metals, etc.). The rigid material may also include various plastics having a high hardness rating and other suitable materials. The high rigidity of the traction element prevents the cantilever from flexing with the sole structure. The sole structure bends or flexes away from the rigid cantilevered stud (selectively engageable traction element).

As described above, an article of footwear may comprise an upper and a sole structure attached to the upper. The sole structure may comprise a sole base member that forms a portion of the ground-contact surface of the sole structure and at least one rigid cantilevered stud. Any number of rigid cantilevered studs may be included. The rigid cantilevered stud may have an attached end and an opposing free end. The attached end of the rigid cantilevered stud may be attached to the sole base member and the free end of the rigid cantilevered stud may extend away from the attached end and form a portion of the ground-contact surface of the sole structure during at least some times during a step cycle. An angle may be formed between the cantilever and the surface of the sole structure that increases when the sole structure is flexed and the cantilever extends farther away from the surface of the sole structure.

The free end of the cantilever may be any desired shape. In some examples, the free end is beveled, angled, or otherwise shaped to increase traction when the free end contacts the ground. One configuration includes a free end that is angled with respect to the body (or main portion) of the cantilever. The free end and the main body portion of the cantilever may define an angle that is acute, obtuse, or right. The angle is faced away from the surface of the sole structure and towards the ground or surface. Any portion of the angled free end may contain a beveled edge or a flat or rounded surface.

The sole structure also may have one or more static traction elements. The static traction elements may be designed to work in tandem with or independently from the one or more selectively engageable traction elements. The static traction element(s) are designed to resist flexion or bending (remain stationary) when a force is applied to them. The static traction elements move in unison with the sole structure. The static traction elements are oftentimes comprised of a hard material, but may include any suitable material. The static traction elements may be positioned in any location on the sole structure of the footwear. The static traction elements may be the "primary" traction for the footwear. Primary traction is often utilized for providing the initial, more generalized traction for preventing slip between the footwear and the surface. Primary traction elements may form at least a portion of the ground-contact surface of the sole structure.

Many examples of primary traction elements are static traction elements. When the sole structure includes both primary, static traction elements and selectively engageable traction elements, the primary, static traction elements may form at least a portion of the ground-contact surface of the sole structure when the sole structure is in both a flexed position and an unflexed position. The selectively engageable traction elements may form a portion of the ground-contact surface of the sole member only when the sole structure is in the flexed position. Thus, the selectively engageable traction elements may form "secondary" traction for the article of footwear. Secondary traction would not constantly engage when the article of footwear contacts the ground, but rather would engage when particular forces are applied to the sole structure or the contour of the surface of the ground on which the article of footwear is in contact changes.

The static traction elements may be positioned near the selectively engageable traction elements in some example structures. In some more specific examples, some static traction elements may be positioned to at least partially shield or protect one or more selectively engageable traction elements. Such protection or shielding may be useful in providing primary traction via the static traction elements and providing additional targeted traction with the selectively engageable traction elements during particular movements. For example, the static traction elements may provide the wearer with traction during the normal run/walk cycle and the selectively engageable traction elements may provide additional traction when the wearer plants his foot and pivots.

The static traction elements may be any shape and configuration. In one example, the static traction elements may be positioned to at least partially surround the selectively engageable traction elements and may comprise a first wall and a second wall. The first wall may extend from the sole structure at a position on a first side of the attached end of the selectively engageable traction element and the second wall may extend from the sole structure at a position on a second side of the attached end of the selectively engageable traction element. In this example, the first wall and the second wall of the static traction element form the ground contact surface in the area of the sole structure that is proximate to the attached end of the selectively engageable traction element. The first wall and the second wall may be positioned on adjacent sides of the selectively engageable traction element or on opposing sides of the selectively engageable traction element in this configuration. The first wall and the second wall may each have a height that exceeds the height of the attached end of the selectively engageable traction element, the heights of each being measured from the surface of the sole structure.

In a more specific example, the first wall and the second wall are configured in a U-shape defining an interior space within which the attached end of the selectively engageable traction element is secured to the sole structure. In another example, the static traction element comprises one wall that is positioned proximate to the attached end of the selectively engageable traction element and forms a ground contact surface (and exceeds the height of the attached end) in the area proximate to the attached end. In this single wall example, the wall may be configured in a U-shape defining an interior space in which the attached end of the selectively engageable traction element is attached to the sole structure.

The sole structure also may define a recess into which at least a portion of at least one of the selectively engageable traction elements is positioned. The attached end of this selectively engageable traction element may be secured to the sole structure within the recess. The recess may be any suitable depth, including a depth that exceeds the height of the attached end of the selectively engageable traction element. This configuration may cause the attached end to be positioned so that it does not form any portion of the ground-contact surface of the sole structure. The recess may be any suitable shape. In one example, the recess may be shaped so that it is capable of receiving at least a portion of the free end of the selectively engageable traction element as well.

The articles of footwear incorporating the selectively engageable traction elements may be athletic footwear known as "cleats." Such cleats with selectively engageable traction elements may be useful in a variety of sports such as soccer, baseball, golf, football, hiking, mountain climbing, lacrosse, and the like.

Specific examples of the invention are described in more detail below. The reader should understand that these specific examples are set forth merely to illustrate examples of the invention, and they should not be construed as limiting the invention.

B. Specific Examples Of Articles Of Footwear With Selectively Engageable Traction Elements The various figures in this application illustrate examples of articles of footwear with selectively engageable traction elements according to this invention. When the same reference number appears in more than one drawing, that reference number is used consistently in this specification and the drawings to refer to the same or similar parts throughout.

Figure 2:
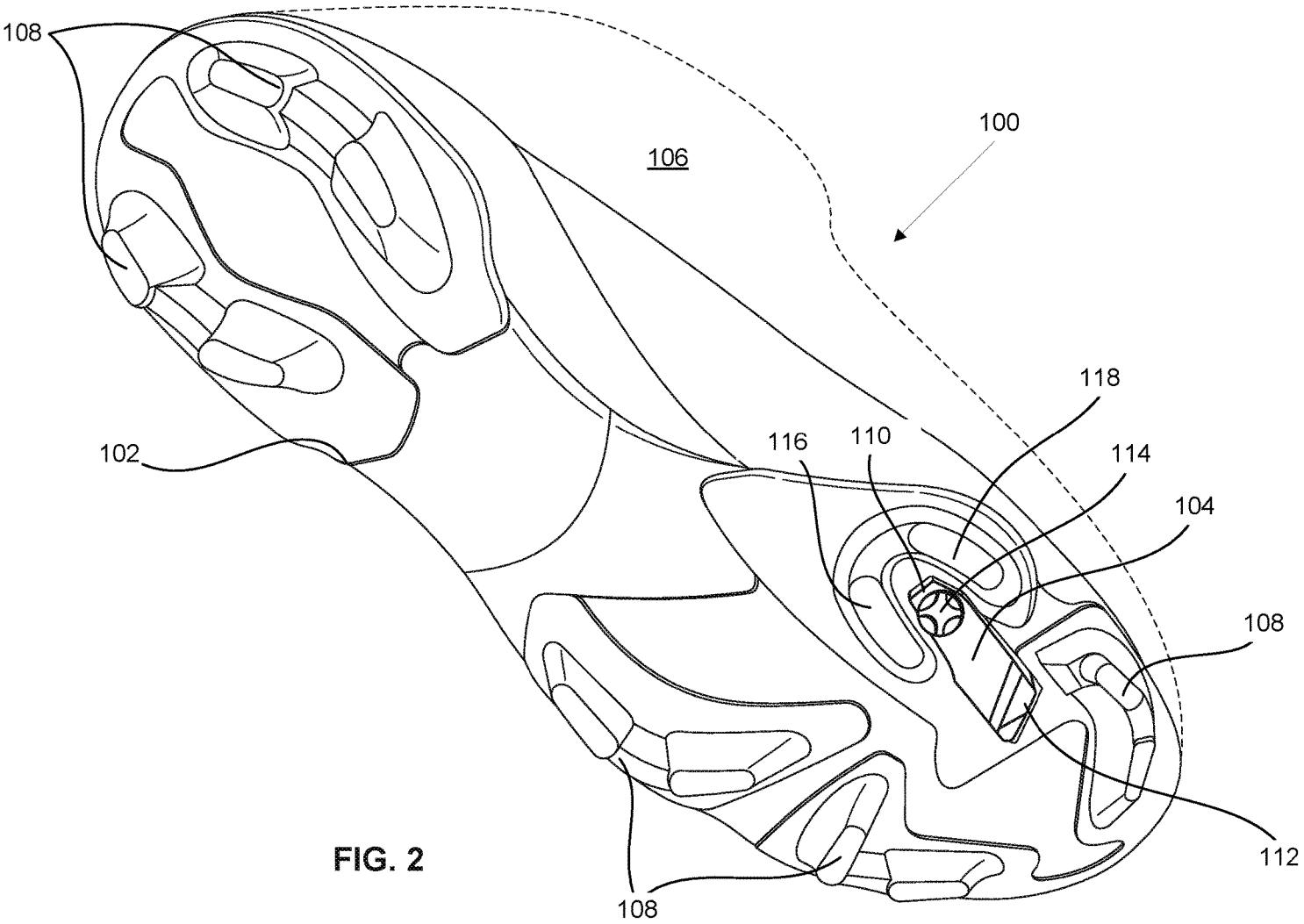
FIG. 2 illustrates another view of the exemplary selectively engageable traction element incorporated into the article of footwear that is illustrated in FIG. 1.

FIG. 1 illustrates a bottom perspective view of an article of footwear 100 having a sole structure 102 with a selectively engageable traction element 104 in the form of a rigid cantilevered stud. FIG. 2 illustrates a bottom perspective view of the same article of footwear 100 from another angle. The article of footwear 100 in these examples comprise an upper 106 and a sole structure 102 attached to the upper 106. The sole structure 102 has a selectively engageable traction element 104 in the form of a rigid cantilevered stud and a plurality of static traction elements 108.

In this example, the rigid cantilevered stud 104 is attached to the sole structure 102 within the forefoot region and more specifically beneath or near the portion of the sole structure that would extend beneath the first metatarsophalangeal joint of the wearer if the wearer's foot was inserted into the footwear 100. The rigid cantilevered stud 104 has an attached end 110 and a free end 112, as described in the examples above. The attached end 110 is secured to the sole structure 102 by a bolt 114. The point at which the bolt 114 secures the attached end 110 of the rigid cantilevered stud 104 to the sole structure 102 is positioned at approximately the portion of the sole structure 102 that would extend beneath the wearer's first metatarsophalangeal joint if the wearer's foot were inserted into the footwear 100 or even slightly rearward (toward the heel) from the line of flex associated with movement of this joint. This point of attachment serves as the point around which the free end 112 of the rigid cantilevered stud 104 may rotate when a force is applied to the sole structure 102 (i.e., when the sole structure is flexed during a step cycle).

FIGS. 1 and 2 also illustrate a plurality of static traction elements 108 positioned at various locations on the sole structure 102. One of the static traction elements 108 is positioned proximate to the rigid cantilevered stud 104. This static traction element 108 comprises a first wall 116 and a second wall 118 and forms a U-shaped configuration around the attached end 110 of the rigid cantilevered stud 104. The first wall 116 and the second wall 118 in this example structure have heights that exceed the height of the attached end 110 and form the initial ground-contact surface around the attached end 110. In this example configuration, the static traction element 108 comprises a portion of the primary traction for the article of footwear 100. Any number of static traction elements 108 and rigid cantilevered studs 104 may be included in the sole structure 102 and they may be configured in any suitable position on the sole structure 102.

The static traction elements 108 may be attached to the sole structure 102 or formed integrally therewith. Some static traction elements 108 are removable and replaceable. Other static traction elements 108 are molded into, glued on, bonded to, or otherwise permanently attached to the sole structure 102. The rigid cantilevered stud 104 is shown in FIGS. 1 and 2 as being attached to the sole structure 102 by a bolt arrangement 114. However, any other form of a mechanical connector may be used to secure the rigid cantilevered stud 104 to the sole structure 102. The rigid cantilevered stud 104 may be secured to the sole structure 102 in any suitable manner that permits the free end 112 of the rigid cantilevered stud 104 to extend away from the sole structure 102 when the sole structure 102 is "flexed." If desired, the attached end 110 of the rigid cantilevered stud 104 may be integrally formed with some portion of the sole structure 102, e.g., by molding.

Figure 3A:
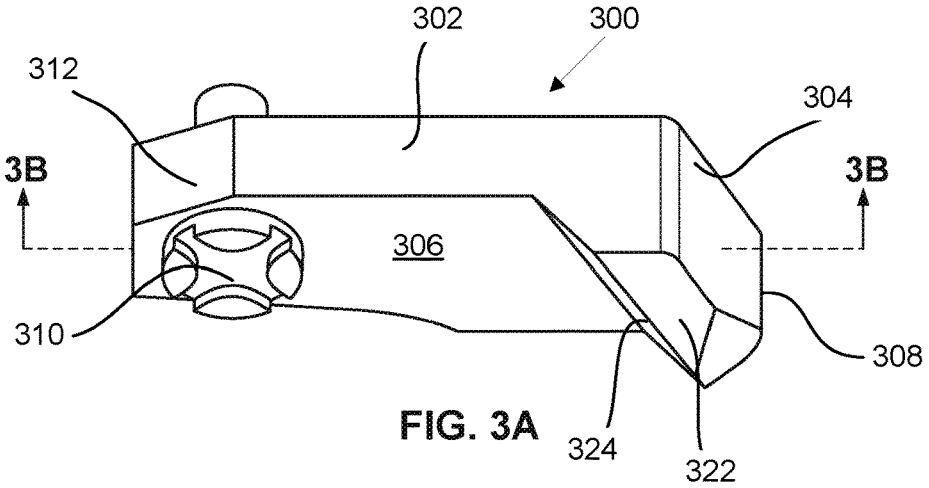
FIG. 3A illustrates an exemplary selectively engageable traction element taken from a first side of the traction element according to aspects of the invention.
Figure 3B:
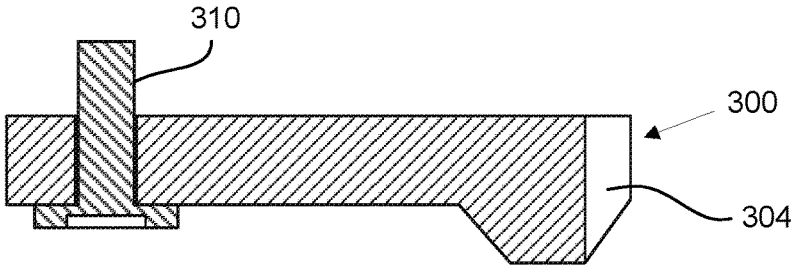
FIG. 3B illustrates a cross-sectional view taken along line 3B of the exemplary selectively engageable traction element that is illustrated in FIG. 3A.
Figure 4A:
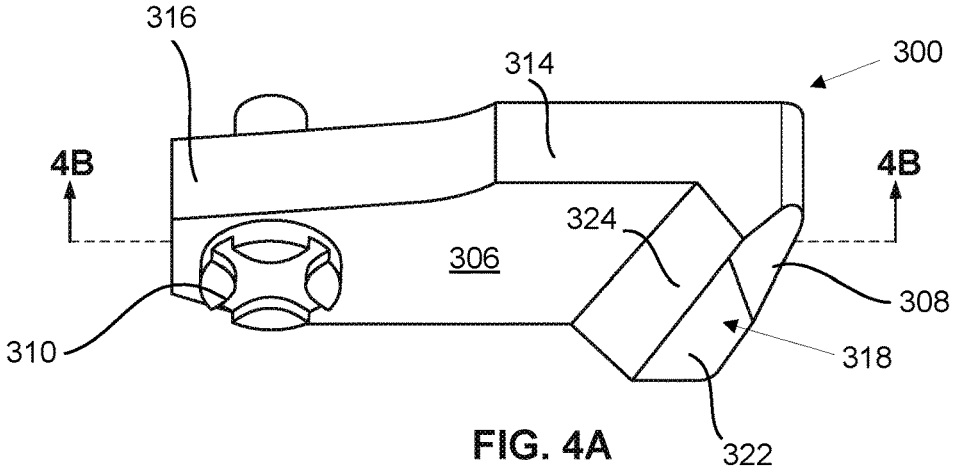
FIG. 4A illustrates the opposite side of the exemplary selectively engageable traction element illustrated in FIG. 3A.
Figure 4B:
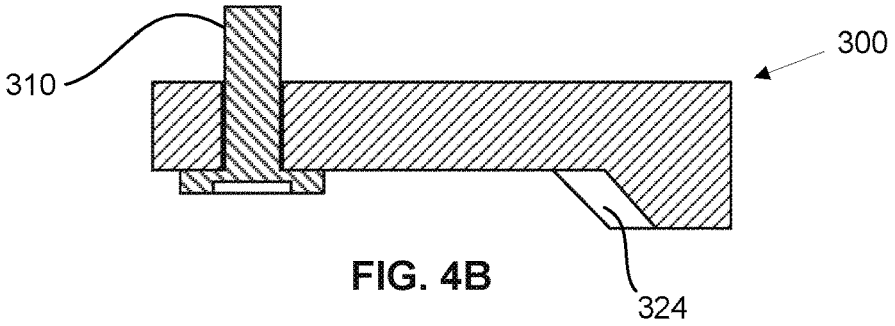
FIG. 4B illustrates a cross-sectional view taken along line 4B of the exemplary selectively engageable traction element that is illustrated in FIG. 4A.

FIGS. 3A, 3B, 4A, and 4B illustrate an example rigid cantilevered stud 300. FIG. 3A illustrates a perspective view of the rigid cantilevered stud 300 from a first side. FIG. 3B illustrates a cross-sectional view taken along line 3B of FIG. 3A of the rigid cantilevered stud 300. FIG. 4A illustrates a perspective view of the rigid cantilevered stud 300 from a second side (opposite the first side illustrated in FIG. 3A). FIG. 4B illustrates a cross-sectional view taken along line 4B of the rigid cantilevered stud 300 of FIG. 4A.

The rigid cantilevered stud 300 illustrated in FIG. 3A shows the rigid cantilevered stud's first side 302, front end surface 304, and bottom surface 306. The first side 302, the front end surface 304, and the bottom surface 306 are flat in this example structure. They each meet one another at approximately 90°. The free end 308 of the rigid cantilevered stud 300 has a beveled corner on the first side of the rigid cantilevered stud 300. Any side or portion of the rigid cantilevered stud 300 may be flat or curved. Sides of the rigid cantilevered stud 300 may meet each other at any suitable angle. A bolt 310 is fitted through the attached end 312 of the rigid cantilevered stud 300 to secure the attached end 312 to the sole structure. The attached end 312 may be secured to the sole structure in any suitable fashion.

The rigid cantilevered stud includes a rigid material, such as metal. The material is hard and rigid enough so that when the sole structure is flexed about the point of attachment between the attached end and the sole structure, the rigid cantilevered stud remains rigid and stationary. Thus, a space is generated between the rigid cantilevered stud and the surface of the sole structure. This configuration causes the free end of the rigid cantilevered stud to extend into the surface with which the sole structure is in contact and oftentimes will pierce such ground or surface. This action provides the user with additional traction or "selectively engageable" traction by the rigid cantilevered stud. In essence, the point of attachment of the attached end of the rigid cantilevered stud guides the movement of how the rigid cantilevered stud comes into contact with the ground or surface by remaining stationary as the sole structure flexes around the point of attachment.

The sole structure oftentimes is flexed in a manner similar to a normal walk or run cycle in which the heel region of the sole structure strikes the surface or ground first, then the motion rolls through the lateral side of the midfoot region of the sole structure, and onto the medial portion of the forefoot region before the foot lifts off of the ground and the cycle begins again. The toes are the last portion of the sole structure to leave the ground. In this normal walk/run cycle, the portion of the forefoot region of the sole structure to which the attached end of the rigid cantilevered stud is secured is in contact with the ground until the midfoot region and heel region begin lifting off of the ground. The lifting of the heel and the midfoot region (i.e., bending along the metatarsophalangeal joint) lifts the attached end of the rigid cantilevered stud, which, due to its rigid nature, pushes the free end of the rigid cantilevered stud into the ground or surface thereby creating additional traction during this targeted motion. This same action of the rigid cantilevered stud occurs when the wearer is pivoting, turning, abruptly starting, stopping, or the like.

As illustrated in the cross-sectional view of the rigid cantilevered stud in FIGS. 3B and 4B, the attached end 312 of the rigid cantilevered stud 300 defines a hole through which the bolt 310 is fitted to secure the attached end 312 to the sole structure. The hole is sized to be a width that is slightly larger than the width of the bolt so that it creates a somewhat tight fit between the bolt and the hole.

FIG. 4A illustrates the rigid cantilevered stud's second side 314 and bottom surface 306. The second side 314 has a curved portion 316 that comprises approximately half of the second side 314. The curved portion 316 creates a tapered appearance of the rigid cantilevered stud 300 from the free end 308 (having the largest width) to the attached end 312 (having the smallest width). The corner formed by the second side 314 and the front end surface 304 is also beveled.

The free end 308 defines a tip 318 that extends downward from the main body portion 320 of the rigid cantilevered stud 300 and forms a portion of the ground-contact surface for the sole structure (and in some examples the only portion of the rigid cantilevered stud that forms a ground-contact surface). As illustrated in FIGS. 3A and 4A, the tip 318 extends downward at approximately 90° with respect to the top surface of the rigid cantilevered stud 300. In other example constructions, the tip 318 may extend downward at any obtuse or acute angle. The tip 318 extends downward (away from the surface of the sole structure) beyond the height of (exceeds the height of) the main body portion 320 and attached end 312 of the rigid cantilevered stud 300. In this example, the tip 318 has a greater height than the rest of the rigid cantilevered stud 300. The tip 318 is defined by a front end surface 314 of the rigid cantilevered stud, a ground-contact surface 322, and an interior surface 324 that faces toward the attached end 312. One corner of the tip 318 that forms the ground-contact surface 322 of the rigid cantilevered stud 300 has a beveled edge. The ground-contact surface 322 of the tip 318 is relatively flat. The tip 318 itself may be shaped in any suitable manner.

The interior surface 324 of the tip 318 may form an obtuse, acute, or right angle with respect to the bottom surface 306 of the rigid cantilevered stud 300 and the ground-contact surface 322 of the tip 318. In FIGS. 3A and 4A, the interior surface 324 is angled at approximately 45° with respect to the bottom surface 306 of the rigid cantilevered stud 318 and the ground-contact surface 322 of the tip 318. Such an angled interior surface 324 permits easy retraction of the tip 318 after it has pierced the ground or surface (i.e., the angled surface is less likely to get "stuck" in the ground or surface and less force is required to remove the tip from the ground or surface). The interior surface may be angled at any suitable angle with respect to the bottom surface 306.

Figure 5A:
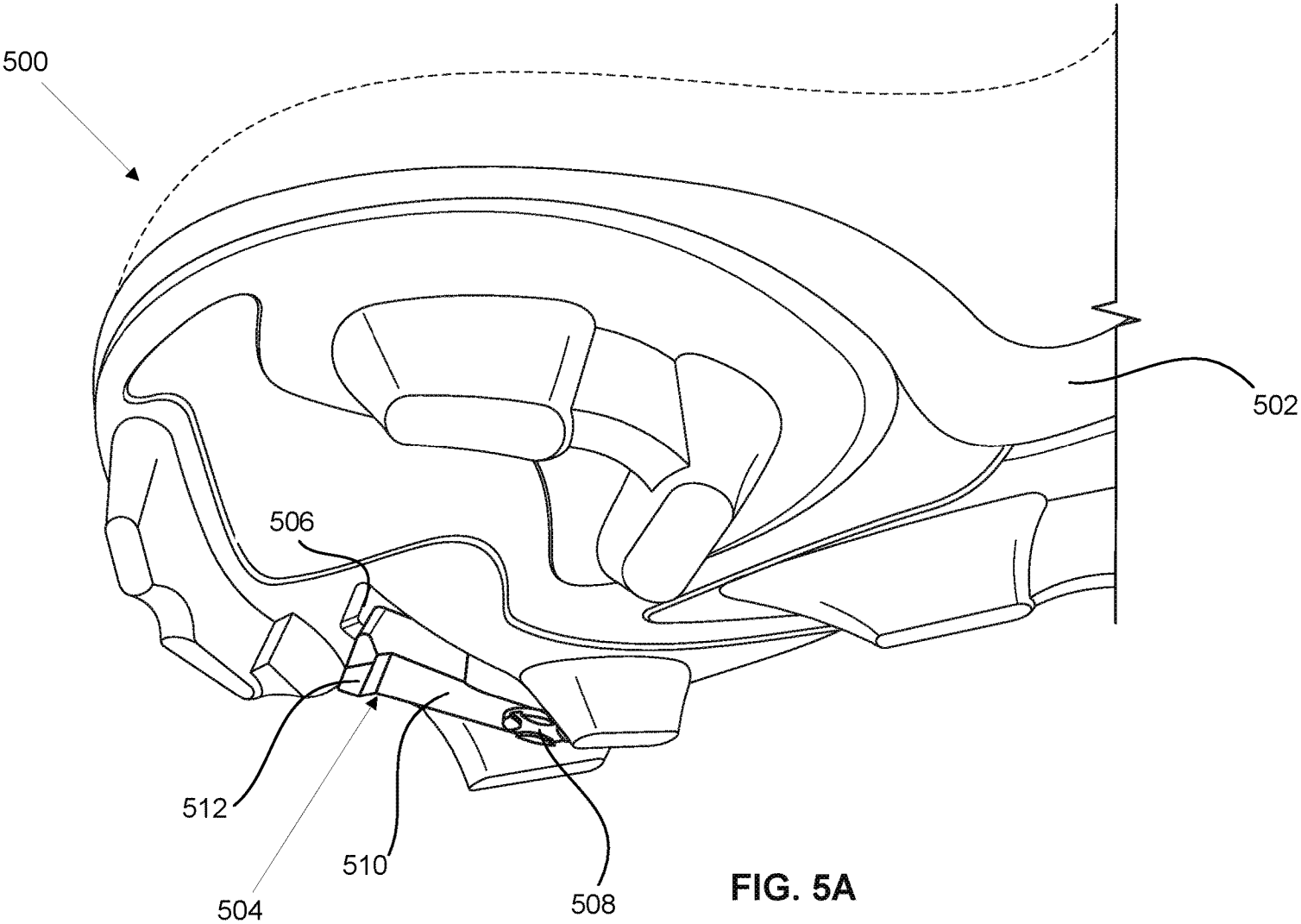
FIG. 5A illustrates a portion of an exemplary sole member including a selectively engageable traction element in which the sole member is in an unflexed position, according to aspects of the invention.
Figure 5B:
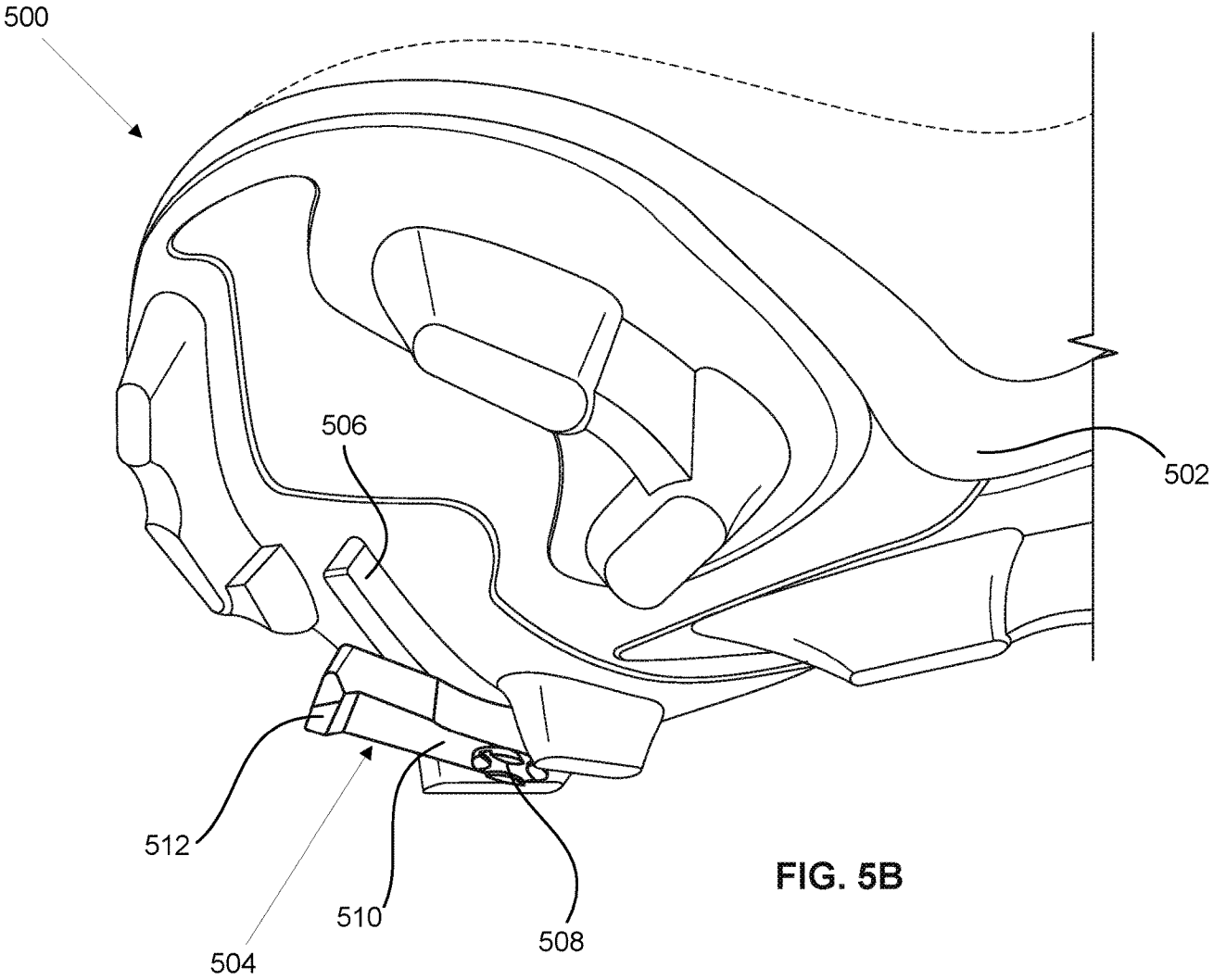
FIG. 5B illustrates the same portion of the exemplary sole member that is illustrated in FIG. 5A with the sole member in the flexed position.

FIGS. 5A and 5B illustrate the forefoot region 500 of a sole structure 502 of an article of footwear according to one example of this invention. FIG. 5A illustrates the position of the rigid cantilevered stud 504 when the sole structure 502 is in an unflexed position. In the unflexed position, the rigid cantilevered stud 504 is positioned relatively close to the surface of the sole structure 502. At least a portion of the rigid cantilevered stud 504 may be fitted within a recess 506. The recess 506 may be any desired height. In this example, the height of the recess 506 is less than the height of the rigid cantilevered stud 504 so that when the sole structure 502 is in the "unflexed" position, only a portion of the rigid cantilevered stud 504 is housed within the recess 506. FIG. 5B illustrates the sole structure 502 when is in its "flexed" position. The flexion occurs around a point of axis defined at or near a plane traversing from the medial to the lateral side of the sole structure 502 that intersects with the attached end 508 of the rigid cantilevered stud 504. In this position, the main body 510 and the free end 512 of the rigid cantilevered stud 504 are a greater distance away from the surface of the sole structure 502. An angle is defined between the surface of the sole structure 502 and the top surface of the rigid cantilevered stud 504. In this position, the free end 512 and the main body portion 510 of the rigid cantilevered stud 504 is no longer housed within the recess 506.

Figure 6A:
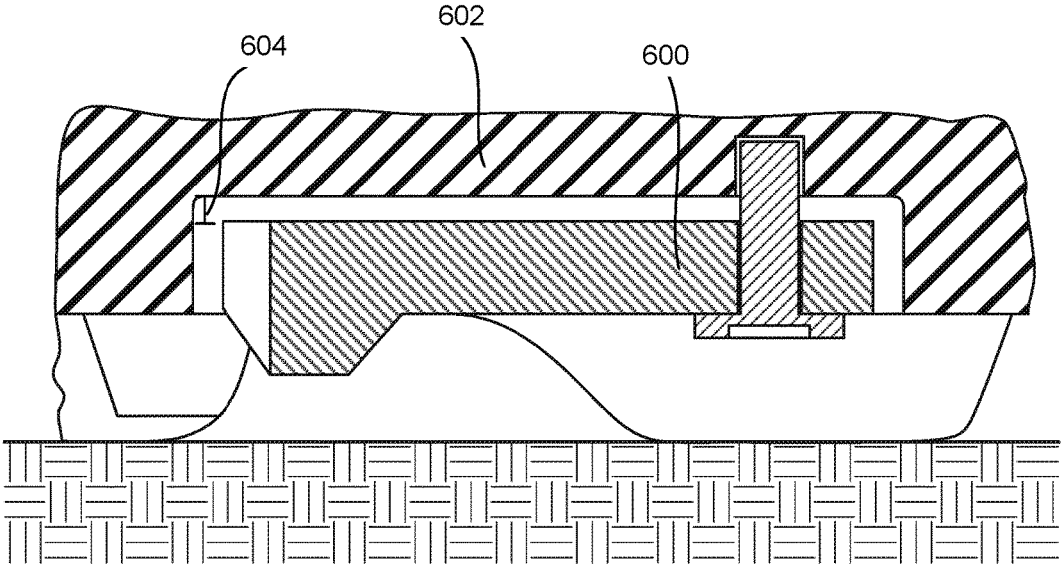
FIG. 6A illustrates a cross-sectional view of the selectively engageable traction element illustrated in FIG. 5A in which the sole member is in the unflexed position.
Figure 6B:
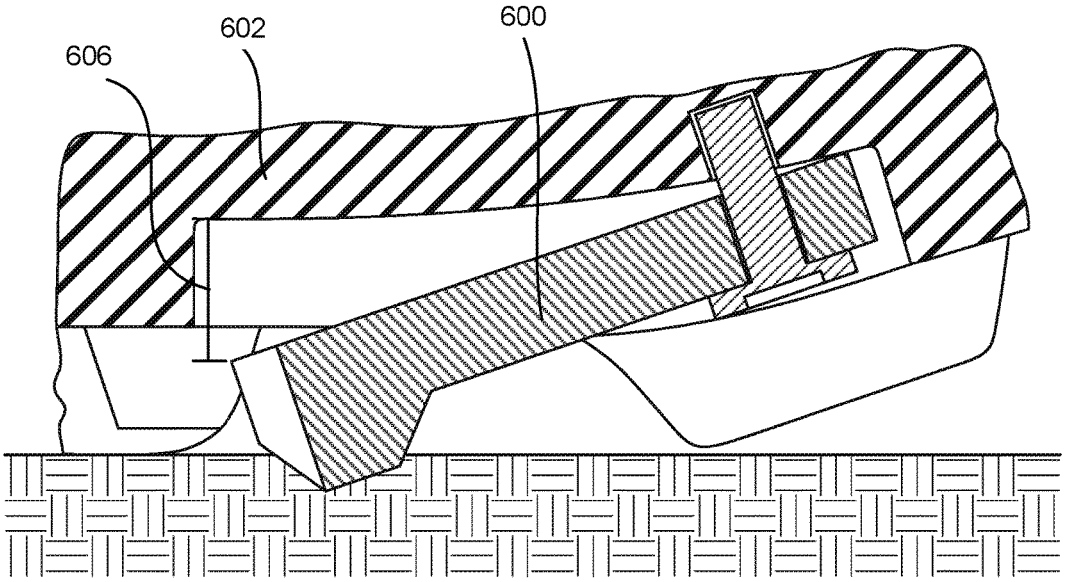
FIG. 6B illustrates a cross-sectional view of the selectively engageable traction element that is illustrated in FIG. 5B in which the sole member is in the flexed position.

FIGS. 6A and 6B illustrate a cross sectional view of the rigid cantilevered stud 600 when the sole structure 602 is in the "unflexed" position and when it is in the "flexed" position, respectively. FIG. 6A illustrates that a 0° angle is formed between the top surface of the rigid cantilevered stud 600 and the sole structure 602. Optionally, if desired, some portion of the rigid cantilevered stud main body may contact the sole structure surface in this unflexed condition. Notably, much of the main body portion of the rigid cantilevered stud 600 extends along but is not permanently connected to the sole surface. FIG. 6B illustrates than approximately 20°-30° angle is created between the top surface of the rigid cantilevered stud 600 and the surface of the sole structure 602 when a flex force is applied to the sole structure. Any angle may be created between the top surface of the rigid cantilevered stud 600 and the surface of the sole structure 602.

The free end of the rigid cantilevered stud is positioned a first distance 604 away from a surface of the sole base member when the sole structure 602 is in an unflexed position, as illustrated in FIG. 6A. The free end of the rigid cantilevered is positioned a second distance 606 away from the surface of the sole base member when the sole structure 602 is in a flexed position, as illustrated in FIG. 6B. The second distance 606 is greater than the first distance 604. As the sole structure 602 flexes, the distance between the free end of the rigid cantilevered stud and the surface of the sole base member increases. In some examples, the distance between the free end of the rigid cantilevered stud and the surface of the sole base member is 0 mm (i.e., the rigid cantilevered stud is positioned next to and in contact with the surface of the sole base member when the sole structure is in the unflexed position). The distance between the free end of the rigid cantilevered stud and the surface of the sole base member is at a maximum when the sole structure is flexed to a maximum flexed position.

C. CONCLUSION

While the invention has been described with respect to specific examples including presently implemented modes of carrying out the invention, numerous variations and permutations of the above described systems and methods may also be implemented. Thus, the spirit and scope of the invention should be construed broadly as set forth in the appended claims.

The invention claimed is:

1. A sole structure for an article of footwear, comprising:

a sole base member that forms a portion of a ground-contact surface of the sole structure; and a rigid cantilevered stud having an attached end and an opposing free end, wherein the attached end is secured to the sole base member by a mechanical connector and the free end extends away from the attached end and is positioned to form a portion of the ground-contact surface of the sole structure during at least a portion of a step cycle, wherein the free end is movable away from the sole base member as a result of flexure of the sole base member in a region of the attached end, the sole base member includes a recess formed therein, and a portion of the free end is contained within the recess when the sole structure is in an unflexed condition.

2. The sole structure of claim 1, wherein the mechanical connector comprises a bolt.

3. The sole structure of claim 1, wherein the rigid cantilevered stud comprises a metal.

4. The sole structure of claim 1, wherein the rigid cantilevered stud is tapered from the free end to the attached end so as to be wider at the free end than at the attached end.

5. The sole structure of claim 2, wherein a line passing from the attached end to the free end extends toward a toe region of the sole structure.

6. The sole structure of claim 5, wherein the sole structure is incorporated into an article of footwear, and the rigid cantilevered stud is positioned beneath a portion of the sole base member configured to correspond to a first metatarsophalangeal joint of a foot of a wearer of the article of footwear during use.

7. The sole structure of claim 2, further comprising a static traction element having a first wall and a second wall, wherein the first wall extends along the sole base member on a first side of the attached end and the second wall extends along the sole base member on a second side of the attached end, the first wall and the second wall form the ground contact surface in an area of the sole base member proximate to the attached end, a portion of the second wall extends forward of the attached end, the first wall and the second wall are configured in a U-shape defining an interior space, and the attached end is positioned within the interior space.

8. The sole structure of claim 2, wherein the free end comprises a downwardly projecting tip, and wherein a bottom surface of the rigid cantilevered stud between the tip and the attached end is flat.

9. A sole structure for an article of footwear, comprising:

a sole base member that forms a portion of a ground-contact surface of the sole structure;

a static traction element having a first wall and a second wall; and a rigid cantilevered stud having an attached end and an opposing free end, wherein the attached end is secured to the sole base member and the free end extends away from the attached end and is positioned to form a portion of the ground-contact surface of the sole structure during at least a portion of a step cycle, wherein the free end is movable away from the sole base member as a result of flexure of the sole base member in a region of the attached end, the sole base member includes a recess formed therein, a portion of the free end is contained within the recess when the sole structure is in an unflexed condition, the first wall extends along the sole base member on a first side of the attached end and the second wall extends along the sole base member on a second side of the attached end, the first wall and the second wall form the ground contact surface in an area of the sole base member proximate to the attached end, a portion of the second wall extends forward of the attached end, the first wall and the second wall are configured in a U-shape defining an interior space, and the attached end is positioned within the interior space.

10. The sole structure of claim 9, wherein a line passing from the attached end to the free end extends toward a toe region of the sole structure.

11. The sole structure of claim 10, wherein the sole structure is incorporated into an article of footwear, and the rigid cantilevered stud is positioned beneath a portion of the sole base member configured to correspond to a first metatarsophalangeal joint of a foot of a wearer of the article of footwear during use.

12. The sole structure of claim 9, wherein the rigid cantilevered stud comprises a metal.

13. The sole structure of claim 9, wherein the rigid cantilevered stud is tapered from the free end to the attached end so as to be wider at the free end than at the attached end.

14. The sole structure of claim 9, wherein the free end comprises a downwardly projecting tip, and wherein a bottom surface of the rigid cantilevered stud between the tip and the attached end is flat.

15. A sole structure for an article of footwear, comprising:

a sole base member that forms a portion of a ground-contact surface of the sole structure; and a rigid cantilevered stud located in a forefoot region of the sole structure and having an attached end and an opposing free end, wherein the attached end is secured to the sole base member and the free end extends away from the attached end and is positioned to form a portion of the ground-contact surface of the sole structure during at least a portion of a step cycle, wherein the free end is movable away from the sole base member as a result of flexure of the sole base member in a region of the attached end, the rigid cantilevered stud is tapered from the free end to the attached end so as to be wider at the free end than at the attached end, the sole base member includes a recess formed therein, and a portion of the free end is contained within the recess when the sole structure is in an unflexed condition.

16. The sole structure of claim 15, wherein a line passing from the attached end to the free end extends toward a toe region of the sole structure.

17. The sole structure of claim 16, wherein the sole structure is incorporated into an article of footwear, and the rigid cantilevered stud is positioned beneath a portion of the sole base member configured to correspond to a first metatarsophalangeal joint of a foot of a wearer of the article of footwear during use.

18. The sole structure of claim 17, wherein the rigid cantilevered stud comprises a metal.

19. The sole structure of claim 15, wherein the free end comprises a downwardly projecting tip, and wherein a bottom surface of the rigid cantilevered stud between the tip and the attached end is flat.

20. The sole structure of claim 15, wherein the attached end is secured to the sole base member by a bolt, the rigid cantilevered stud comprises a metal, and a line passing from the attached end to the free end extends toward a toe region of the sole structure.

21. The sole structure of claim 20, further comprising a static traction element having a first wall and a second wall, wherein the first wall extends along the sole base member on a first side of the attached end and the second wall extends along the sole base member on a second side of the attached end, the first wall and the second wall form the ground contact surface in an area of the sole base member proximate to the attached end, a portion of the second wall extends forward of the attached end, the first wall and the second wall are configured in a U-shape defining an interior space, and the attached end is positioned within the interior space.

* * * * *